United States Patent [19]

Cronan et al.

[11] 3,953,092

[45] Apr. 27, 1976

[54] MINI-DESK

[75] Inventors: William J. Cronan; Jerry N. Appling, both of Northport, Ala.

[73] Assignee: Artistic Innovation Developers, Inc., Tuscaloosa, Ala.

[22] Filed: Feb. 3, 1975

[21] Appl. No.: 546,459

[52] U.S. Cl. ..... 312/233; 312/231

[51] Int. Cl.[2] ..... A47B 27/04

[58] Field of Search ..... 312/231, 232–235, 312/244; 24/67.7

[56] References Cited

UNITED STATES PATENTS

| | | | |
|---|---|---|---|
| 791,506 | 6/1905 | Simmons | 312/244 |
| 3,271,091 | 9/1966 | Henry | 312/231 |
| 3,414,343 | 12/1968 | Thomas | 312/244 |
| 3,828,402 | 8/1974 | Gorman | 24/67.7 |

*Primary Examiner*—Casmir A. Nunberg
*Attorney, Agent, or Firm*—Isaac P. Espy

[57] ABSTRACT

A portable desk combining storage capability of an openable container for legal size and other conventional folding files, and for papers and printed forms in general, and a writing surface with clamping system devised to hold multiple copies of pressure-sensitive forms with minimal pressure. The article consists of a slidable compartmented receptacle movably positionable to (a) either side of a covering writing surface equipped with a clamping system, or (b) a position directly below the writing surface for relatively moisture resistant storage of forms, papers, and writing equipment. The receptacle is equipped with an integral loop of like material at one end for hand carrying and storage on wall hooks. The clamping system is especially suited for pressure-sensitive duplicating forms. The article may be suitably made of plastic of various kinds, with a clamping means made of stamped sheet metal.

3 Claims, 7 Drawing Figures

MINI-DESK

BACKGROUND OF THE INVENTION

The claimed invention relates generally to two fields and is directed to a novel combination of the two: one, articles of manufacture used to carry papers, files and forms, commonly called "brief cases", "attache' cases", or satchels; and two, articles of manufacture created to provide portable writing surfaces, including means to suitably clamp writing material to the writing surface.

Prior art is composed mainly of cases or satchels used to carry papers, and writing surfaces such as "clipboards", also used to hold quantities of papers; and rather fixed or cumbersome combinations of the two such as would be used in permanent positions or placed on rollers to be moved within a relatively small area.

An example of prior art which most nearly approaches the claimed invention are aluminum sheet metal receptacles used to carry papers within and having a writing surface within or on the outer covering. Its disadvantages, which the Mini-Desk overcomes, are (1) lack of moisture resistance, (2) small size but heavier unit weight, (3) lack of a receptacle compartment for writing equipment storage, (4) lack of convenient handle, (5) lack of capacity to hang vertically and (6) expense of manufacture compared with features.

A part of the claimed invention, the clamping system, is an improvement over prior art in its function and purpose. The claimed clamping system simplifies manufacture and assembly when compared with prior art, and provides a clamping force suitable to restrain a single copy or relatively few copies of pressure-sensitive paper, such as "no-carbon required" paper, yet is tensioned as to provide only enough to restrain without causing marks on copies through undue clamping force.

O'Connell, U.S. Pat. No. 3,423,798 and U.S. Pat. No. 3,599,295 teaches clamping devices suitable for fixed writing surfaces and these devices are of a relatively complex nature. Medendorp, U.S. Pat. No. 953,631, taught an adjustable clamping device for a clip board. See also, U.S. Pat. No. 1,743,000 to Meader; U.S. Pat. No. 1,671,725 to Jones; U.S. Pat. No. 1,671,869 to Meader; U.S. Pat. No. 1,834,268 to Cassedy; U.S. Pat. No. 1,871,719 to Meader; U.S. Pat. No. 2,334,380 to Brinker; U.S. Pat. No. 2,862,328 to Wadsworth; U.S. Pat. No. 1,273,353 to Fuller; and U.S. Pat. No. 1,198,379 to Elder. All of these prior art devices have disadvantages which are overcome by the novel simplicity and combination of functions of the Mini-Desk.

SUMMARY OF THE INVENTION

The present invention is directed to a portable desk providing a novel combination of paper and business form storage within a lightweight, portable receptacle which has a covering surface suitable for clamping individual or small multiples of copies, and further suitable for writing thereon. The present invention is particularly suited as a self-contained portable desk surface capable of containing both writing equipment, blank forms and papers, and executed forms and papers.

The receptacle is essentially rectangular and compartmented in form, one compartment of which is sized to hold legal size folders and their contents, and variations in sizes made for other specific form sizes. Adjacent compartments are sized to retain writing equipment and yeoman supplies such as pencils, pens, erasers, and paper clips. The receptacle as a whole has a depth relatively smaller than its rectangular plan dimension and is sized to hold multiple files, pads, or forms. The tray-like receptacle, in its preferred embodiment is slidably located beneath a relatively rigid writing surface which covers the entire receptacle and is connected thereto by male-and-female grooved means, allowing movement of the tray laterally with respect to the writing surface. The receptacle is provided a carrying handle fashioned as a loop and is preferably integral with the tray, and also serves as means to be stored vertically by suspension from a wall projection.

The writing surface is provided with a clamping system consisting of a clamping plate tensioned against the writing surface by a spring steel c-shaped clip. The system, with only two parts, is fastened into recesses and slots in the writing surface. The writing surface slides laterally across the compartmented receptacle, exposing first either the writing equipment storage or alternatively the form or paper storage compartment. A latching system prevents casual movement of the surface with respect to the receptacle by slight projections beneath the writing surface; the restriction to lateral movement or un-latching is effected by a slight distension or bending of the writing surface thereby removing the projections from the path of the exterior compartment walls. The same projections prevent unintentional complete removal of the receptacle since the projection further restricts travel by striking the interior compartment diaphragm wall.

It is an object of the invention to provide a lightweight and portable desk-like writing surface with storage and carrying capacity.

It is another object of the invention to provide an article of manufacture which can be efficiently and economically produced by compression molding of plastic.

It is another object of this invention to provide a receptacle for papers which will be substantially resistant to external moisture.

It is another object of the invention to provide a clamping system which will not, by undue pressure, mark pressure-sensitive paper by its clamping force.

Other objects and a fuller understanding of the invention will be had by referring to the following description and claims of a preferred embodiment thereof, taken in conjunction with the accompanying drawings wherein like reference characters refer to similar parts throughout the several views in which:

BRIEF DESCRIPTION OF THE DRAWINGS

FIG. 3 is a partial side view of the writing surface only showing the projection 2 shown on FIG. 1.

DESCRIPTION OF THE PREFERRED EMBODIMENT OF THE INVENTION

Figures 1, 2:
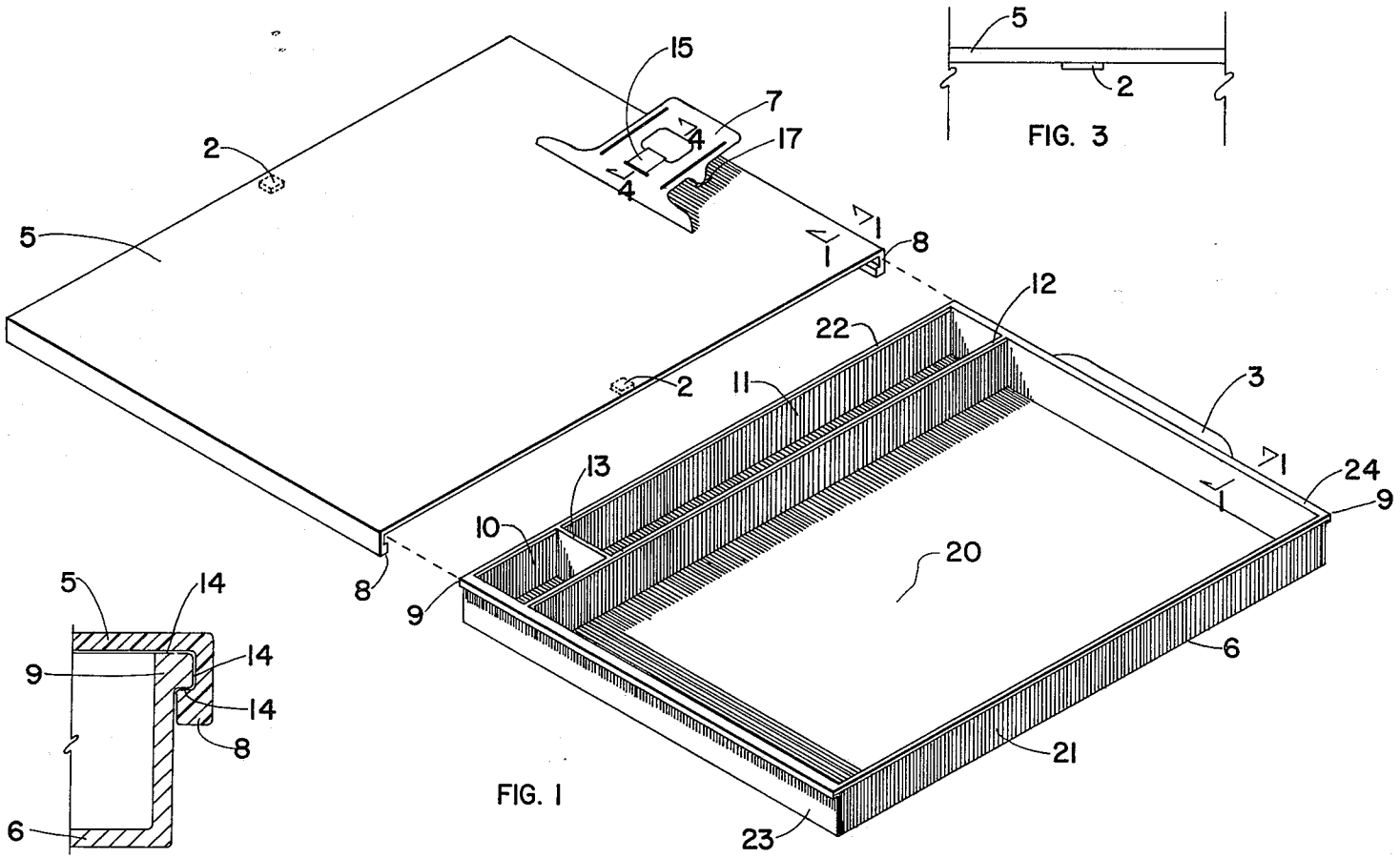
FIG. 1 is an isometric exploded view of the Mini-Desk, with the writing surface moved laterally to the left of the compartmented receptacle.
FIG. 2 is a partial cross-section view taken along line 1—1 of FIG. 1, looking in the direction of the arrows.

Although specific terms are used in the following description for the sake of clarity, these terms are intended to refer only to the particular structure of my invention selected for illustration in the drawings and are not intended to define or limit the scope of the invention.

Referring now to the drawings, I show in FIG. 1 an isometric view of the Mini-Desk with the writing surface 5 shown exploded laterally to the left, exposing the compartmented receptacle 6.

Referring to FIGS. 1 and 3, the writing surface 5, which is also the sliding cover for the compartmented receptacle 6, is preferably made of a wood-filled phenolic molding compound, but may be made of any other smooth surface, relatively rigid material. Attached to and part of the invention is a clamping means 7, attached to the writing surface 5 with a spring steel clip 15. While other clamping means may be used, the preferred embodiment is the clamping system 7 shown, made of a light gauge corrosion-protected metal, preferably a galvanized iron stamped article securely but quickly attached to the writing surface by a spring steel c-shaped clip 15. Integral with the writing surface 5 are molded grooves 8, for adaptably fitting with tongues 9 which are integral with the compartmented receptacle 6. The tongues and grooves retain the writing surface in position vertically and longitudinally, allowing movement only laterally, and then subject to the restriction caused by interference of the projection 2 with the respective side walls of the compartments of the receptacle.

Figure 6:
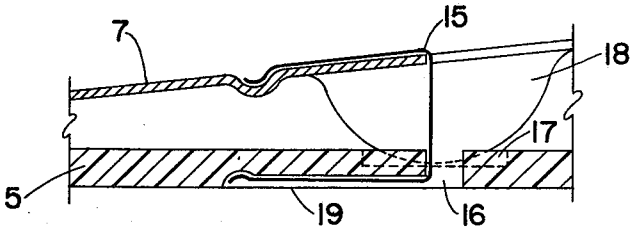
FIG. 6 is a partial cross-section view taken along line 4—4 of FIGS. 1 and 7, looking in the direction of the arrows.
Figure 7:
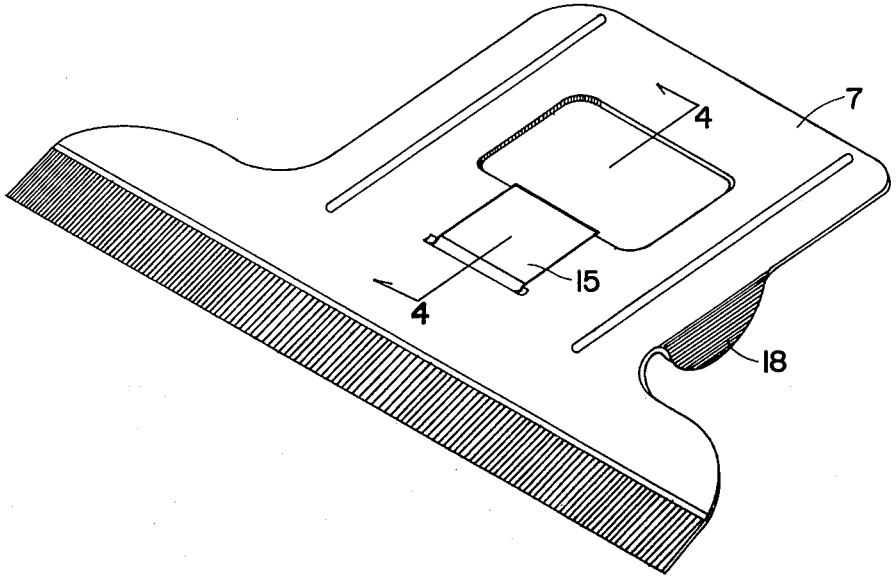
FIG. 7 is an isometric view of the clamping system, apart from the writing surface.

Referring to FIGS. 1, 6 and 7, indentions 17 are provided to form a travel way for the tabs 18 which are part of and perpendicular to the plane of the clamp 7. The spring steel c-shaped clip 15 is fastened through a slot 16 in the writing surface and nests in a recess 19 on the reverse side of the writing surface, 5.

FIG. 2 shows a partial cross-sectional view of the assembled writing surface 5 and the compartmented receptacle 6 at the longitudinal ends where the tongue 9 and groove 8 provide lateral movement, with a slight spatial tolerance 14 for smooth lateral movement.

Figure 4:
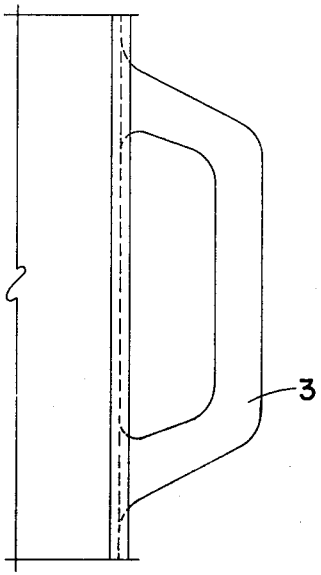
FIG. 4 is a partial plan view of the compartmented receptacle only, showing the plan view of the carrying handle 3.
Figure 5:
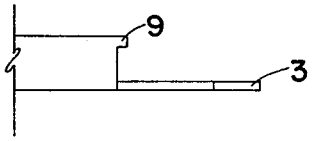
FIG. 5 is a partial side view of the compartmented receptacle only, showing the elevation of the carrying handle 3.

Referring to FIGS. 1, 4 and 5, the compartmented receptacle is preferably made of wood-filled phenolic molding compound, but may also be made of other easily molded or fabricated material including materials either more or less rigid than the preferred material. A carrying and hanging handle 3 is integral with the compartmented receptacle 6, centrally positioned at the clamping longitudinal end of the article and having its bottom surface flush with the bottom surface of the compartmented receptacle.

Referring again to FIG. 1, compartments are shown, including a larger compartment 20 for storage of papers or files, preferably large enough for legal size files, compartment 11 for smaller articles such as pens and pencils, and compartment 10 for even smaller articles such as paper clips and erasers. Compartments 10 and 11 are separated from each other by a small diaphragm wall 13, and compartments 10 and 11 are separated from compartment 20 by a diaphragm wall 12. Diaphragm wall 12, and side walls 21, 22, 23 and 24, provide support for the writing surface 5.

It will be observed that the writing surface is locked into place by the projections 2, but may be unlocked laterally by slight pressure upwardly on the middle of the longitudinal edges of the writing surface 5, making the projections 2 clear the side walls 21 and 22. After the first interference is cleared, it is observed that the projection on the following side will again strike the diaphragm wall 12, stopping travel; this allows access to the compartment sought without removing entirely the writing surface 5 completely from the compartmented receptacle 6.

We claim:

1. A portable desk comprising
   a. A relatively rigid and essentially rectangular receptacle, having a depth relatively shallow when compared with length and width, having means connected thereto for carrying;
   b. A writing surface which also serves as a cover for the receptacle, having means for being selectively retained on said receptacle, wherein said selective retaining means comprises flanged tongues on opposite parallel receptacle sides, and flanged means having grooves on matching opposite parallel writing surface sides, allowing lateral movement; said movement restricted by projections on the underside of the writing surface laterally across the diaphragm and side walls of the receptacle, said writing surface being sufficiently resilient to allow the projections to clear the side walls of the receptacle upon application of pressure upwardly on the writing surface, allowing clearance of said projections over said walls;
   c. Means attached to the writing surface for selectively retaining writing medium;
   d. A plurality of compartments in sizes for separately containing standard writing media and files therefor, writing instruments and paraphernalia; diaphragms for said compartments also creating support for the writing surfaces in wider models of the invention.

2. The invention of claim 1 wherein said carrying means comprises an integrally connected loop mounted flush with the underside of the receptacle for carrying and storing by hanging vertically.

3. The invention of claim 2 wherein said selective writing medium retaining means comprises a clamping plate rotatably pivoted on integral tabs bent at right angles to said plate, which tabs are positioned in indentations in the desk writing surface, preventing lateral and longitudinal translation but allowing said pivotal motion; said clamping plate being fastened to said writing surface by a c-shape clamp, said clamp also providing means for slightly urging said clamping plate against the writing surface thereby gently retaining the writing medium.

* * * * *